US005507841A

United States Patent [19]

Heckman et al.

[11] Patent Number: 5,507,841

[45] Date of Patent: Apr. 16, 1996

[54] FAN CLEANER APPARATUS

[75] Inventors: Carl H. Heckman, Farmingdale; John Baumann, Islip, both of N.Y.

[73] Assignee: Uniwave, Inc., Farmingdale, N.Y.

[21] Appl. No.: 421,419

[22] Filed: Apr. 20, 1995

[51] Int. Cl.[6] ..... A47L 5/38

[52] U.S. Cl. ..... 15/301; 15/312.1; 15/316.1

[58] Field of Search ..... 73/316.1, 312.1, 73/301

[56] References Cited

U.S. PATENT DOCUMENTS

| | | | |
|---|---|---|---|
| 2,183,758 | 12/1939 | Walker | 15/312.1 |
| 4,219,155 | 8/1980 | Goerss | 15/320 X |
| 5,081,737 | 1/1992 | Diies | 15/316.1 |
| 5,175,905 | 1/1993 | Gutschmit | 15/316.1 X |

*Primary Examiner*—Chris K. Moore
*Attorney, Agent, or Firm*—Schweitzer Cornman & Gross

[57] ABSTRACT

A cleaning apparatus for use in conjunction with textile blowers of the type having a blower mounted to a rotating arm includes a pneumatic coupling to pass compressed air from a stationary source to a nozzle assembly mounted to the rotating arm. The coupling may include a valve which operates periodically during the arm rotation to pass the compressed air on an intermittent basis. The nozzle assembly may preferably include a plurality of nozzles arrayed in a common plane to form a curtain of air which impinges on the blower to remove accumulated lint and other debris therefrom.

15 Claims, 4 Drawing Sheets

FAN CLEANER APPARATUS

The present invention relates to the mechanical arts, and in particular to an apparatus and method for removing accumulated lint and similar matter from fan and blower equipment used in conjunction with circular knitting machines and similar devices.

BACKGROUND OF THE INVENTION

During the operation of circular knitting machines and similar industrial textile equipment, large amounts of lint and fabric particles are generated. To keep such particles from interfering from the proper operation of the equipment, fan and blower systems are employed. In conjunction with circular knitting machines, a typical fan/blower unit employed includes a central vertical stalk or shaft to which a generally horizontally-extending arm is mounted by use of an appropriate rotary joint. A fan is mounted at the distal end of the arm, which is dimensioned to locate the fan proximate the circumference of the knitting machine with which it is utilized. As depicted in pending U.S. patent application Ser. No. 08/296,224 of Aug. 25, 1994 to one of the present inventors, the fan rotates about a horizontal axis as the arm and fan sweeps around the circumference of the knitting machine about the vertical axis of the central shaft. The combination of rotations typically provides efficient removal of the lint and other particles from the critical portions of the machine.

While such devices are well suited for removal of lint from the knitting machines, the fan units themselves become the target for lint and other particles, generated both by the action of the knitting machines as well as operation of the fan itself. The blast of air from the front surface of the fan creates a complementary reduced-pressure effect at the rear of the fan, attracting suspended lint and dust particles. These particles are drawn towards and through the fan, and settle on the exposed surfaces of the fan blades, its guard, and motor. As they collect they interfere with the proper operation of the fan unit.

Because it is often impractical or impossible to shut off the fan because of the resulting down time to the knitting machine with which it is used, cleaning of the fans is usually attempted while the fans are in operation. The cleaning methodology typically utilizes an air hose having a nozzle fastened to the end of a long pole or stick. The pole is held by a maintenance worker and attempted to be manipulated to bring the air hose nozzle into the proximity of the fan while it rotates and revolves to blow the accumulated lint and dust off the fan. More often than not, however, the pole collides with the fan, damaging both the hose and the fan. In addition, even when successful, such cleaning is of marginal efficiency at best, since it is very difficult for the maintenance worker, even if relatively skilled, to maintain the air spray at the rotating fan for a significant enough time to thoroughly clean the fan.

It is accordingly a purpose of the present invention to provide an apparatus for the automated cleaning of rotating fans such as are utilized in conjunction with circular knitting machines.

Another purpose of the present invention is to provide an apparatus which may be installed upon, or retrofit upon, a circular knitting machine fan unit to effect cleaning thereof.

Still another purpose of the present invention is to provide an apparatus which can provide controlled cleaning, by the use of compressed air, to the fan during operation.

Yet another purpose of the present invention is to provide a cleaning apparatus for such circular knitting machine fans which provides a continuously accurately aligned and projected air flow to efficiently remove lint and other particles from rotating fans.

BRIEF DESCRIPTION OF THE INVENTION

In accordance with the foregoing and other objects and purposes, the present invention comprises a nozzle assembly mounted to a portion of a rotating fan unit proximate the fan. A rotating pneumatic joint is provided between the rotating and stationary portions of the fan unit and couples the nozzle assembly to a stationary source of compressed air. Such an arrangement permits a flow of air to be maintained to the nozzle assembly during fan rotation. In a preferred embodiment, however, the compressed air does not continuously exit from the nozzle assembly, but is emitted in a timed or pulsed fashion to more efficiently impinge upon the fan unit. Control over air flow may be by an electromechanical timer or, preferably, by use of a valve which may be incorporated into the rotating pneumatic joint. The combination of closely spaced jets impinging on the rotating fan element in a timed manner removes lint and other particulate matter from the fan on a generally continuous and efficient manner, and without the necessity for halting operation of the fan unit.

BRIEF DESCRIPTION OF THE DRAWINGS

A fuller understanding of the present invention and the features and construction thereof, may be accomplished upon review of the following detailed description of a preferred, but nonetheless illustrative embodiment thereof, when reviewed in conjunction with the annexed figures, wherein.

DETAILED DESCRIPTION OF THE INVENTION

Figure 1:
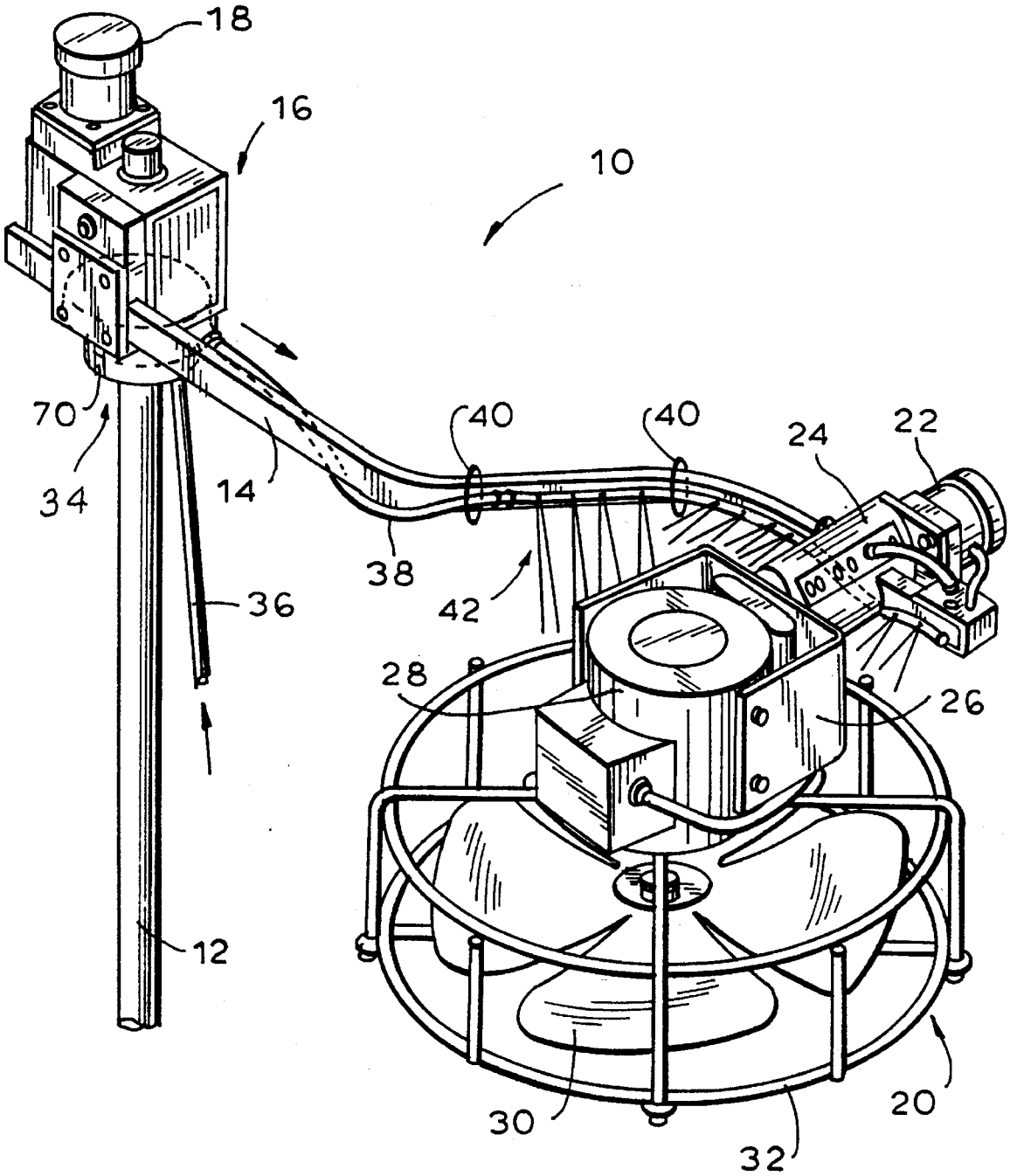
FIG. 1 is a perspective view of the invention mounted on a circular knitting machine fan unit.

With initial reference to FIG. 1, a typical circular knitting machine fan unit 10 with which the present invention is utilized includes upright 12 supporting fan arm 14 which rotates in a horizontal plane about the upright 12 through journal assembly 16, which includes rotational drive motor 18. A commutator system within the journal assembly provides continuous electric power to the motor as it, and the arm, rotates. Mounted to the distal end of the arm 14 is fan assembly 20. The fan assembly typically comprises a second drive motor 22, the shaft of which is connected through commutator 24 to fan yoke 26 which supports blower motor 28 and blower fan 30. Motor 22 causes the fan yoke and the mounted blower motor and fan to rotate about the horizontal axis about which the yoke pivots. Concurrently with such rotation, the blower motor 28 is causing the blower fan 30 to generate a blast of air which sweeps across the knitting machine unit in a generally circular corkscrew motion. The commutator 24 couples electrical power to both the motor 22 and the blower motor 30, and receives power from the main journal assembly 16 and the commutator located therein by an appropriate cable (not shown) either within or affixed to the exterior of the arm 14. A fan guard 32 surrounds the rotating blades of the fan 30.

In accordance with the present invention, journal assembly 16 also includes a rotating pneumatic joint 34 which couples a source of compressed air (not shown) fed through inlet line 36 to pipe 38, which extends between the rotary joint 34 and a nozzle assembly 42 which is oriented proximate the fan assembly 20. Pipe 38 is preferably led along the arm 14, and may be affixed thereto by bands 40 or other appropriate fasteners. The distal end of the pipe, located proximate the commutator 24, is capped. The nozzle assembly may preferably be formed by a portion of the pipe, and may comprise a plurality of holes in the side wall of the pipe or a series of threaded nozzles tapped into the pipe side wall. The nozzles may be all aligned in a common horizontal plane to provide a sweep or wash of air extending outwardly from the arm a distance sufficient to impact the fan guard 32, as well as the rotating fan blades 40 and other elements of the rotating fan unit. The combination of a horizontal curtain of air impinging upon a rotating fan unit provides a particularly effective lint and particle removal process. Alternatively, however, other nozzle patterns may be employed.

As depicted in FIG. 1, the arm 14 may have a crook or bend proximate its distal end. By locating the nozzle assembly along that portion of the arm, and incorporating a bent configuration for the nozzle assembly, a multi-directional air flow may be developed, further improving the efficiency of the cleansing air flow. It is of course to be recognized that the nozzle assembly need not follow the contour of the arm, and that other or similar bent, curved or otherwise non-straight configurations within a common plane or otherwise may be provided to direct the air sweep as suggested by the relative location and rotation of the fan unit.

Figure 2:
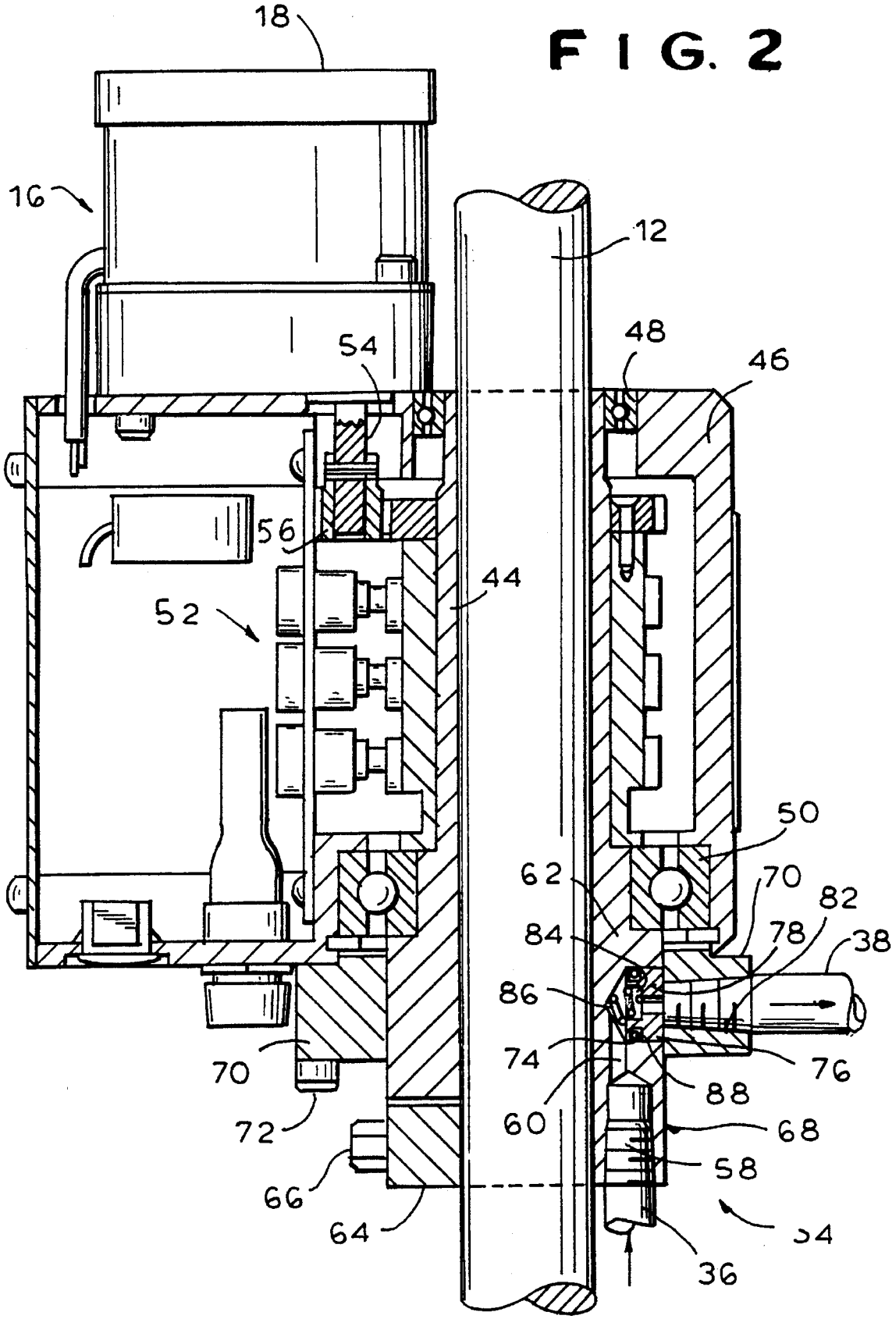
FIG. 2 is a cross-sectional elevational view of the journal between the knitting machine fan upright and arm.

Referring to FIG. 2, which details the central journal assembly 16, the main body portion 44 of the journal assembly is rigidly affixed to the upright 12. Mounted for rotation about the main portion 44 is outer portion 46, with upper and lower bearings 48, 50, respectively, providing for low-friction rotation. A commutator assembly 52, as known in the art, provides electrical power from a fixed source to the arm drive motor 18, which is mounted to the outer portion 46, and whose geared shaft 54 engages appropriate complimentary gears 56 to drive the outer portion around the upright. The fan arm 14 (not shown) is mounted to the outer portion.

The main body portion of the journal assembly 16 extends downwardly below the outer portion, and is provided with a vertical threaded bore 58 to accept a mating threaded end of air line 36 and leads through passageway 60 to pneumatic journal portion 62. The main body is clamped to the upright by collar 64 and bolts 66.

The pneumatic journal portion of the journal assembly comprises a cylindrical lateral face 68 formed along the lower portion 62 of the main journal body portion 44. A ring 70 embraces the face and rotates thereabout. The ring may be mounted to the outer portion 46 by one or more mounting bolts 72, coupling the parts together for common rotation.

The air passageway 60 leads from the inlet line 36 to a window 74 in the lateral face of the lower portion 62. The window may be circular. Mounted in the window is a mating block 76 having a convex-curved outer face 78 which conforms to the curvature of the lower portion lateral face. The block, which is preferably of a low-friction plastic composition, is provided with a transverse bore 80 which is aligned with a complimentary bore 82 through the ring 70, which accepts an end of the pipe 38. The block's bore 80 is provided with a widened counterbore portion 84 into which compression spring 86 is mounted. The spring 86, which also bears against the back inner wall of the window, presses the block 76 firmly against the ring 70. O-ring 88 seals the block against the side wall of the window.

Figure 5:
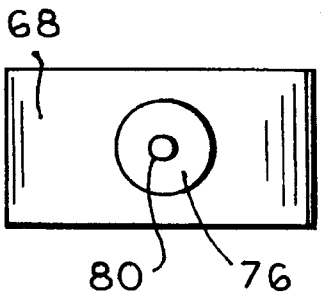
FIG. 5 is a detailed elevation view of a portion of the means by which air is coupled between the fixed and rotating portion of the journal.

It is to be appreciated that, as the ring 70 rotates, the bore 80 in the window block 76 becomes aligned with the bore 82 in the ring, allowing the compressed air to flow from inlet line 36 through the pneumatic joint and into the pipe 38. With continuing rotation, the two bores become unaligned, the inner face of the ring 70 then providing a sealing face for the bore 80, preventing the compressed air from escaping the joint. In this manner, the flow of air through the pipe 38 to the nozzle assembly 42 is valved or controlled. With one window 74, the flow of air to the nozzles occurs once per arm revolution. The bore 80 may be circular as shown in FIG. 5, or can take a generally oval shape to provide increased alignment time with the ring's bore, and thus a greater duration flow. For an arm rotational speed of 2 rpm, and a ten second fan secondary rotation period, a circular bore providing a 2 second spray duration has been found effective. By using a plurality of interconnected window sites having appropriately-chosen bore sizes, the air flow and spray may be chosen to impinge upon the fan assembly at different points during its rotation cycle, as may be desired. Since air flow is not continuous, the amount of compressed air, and thus the energy required for the cleaning operation, is minimized.

Figure 3:
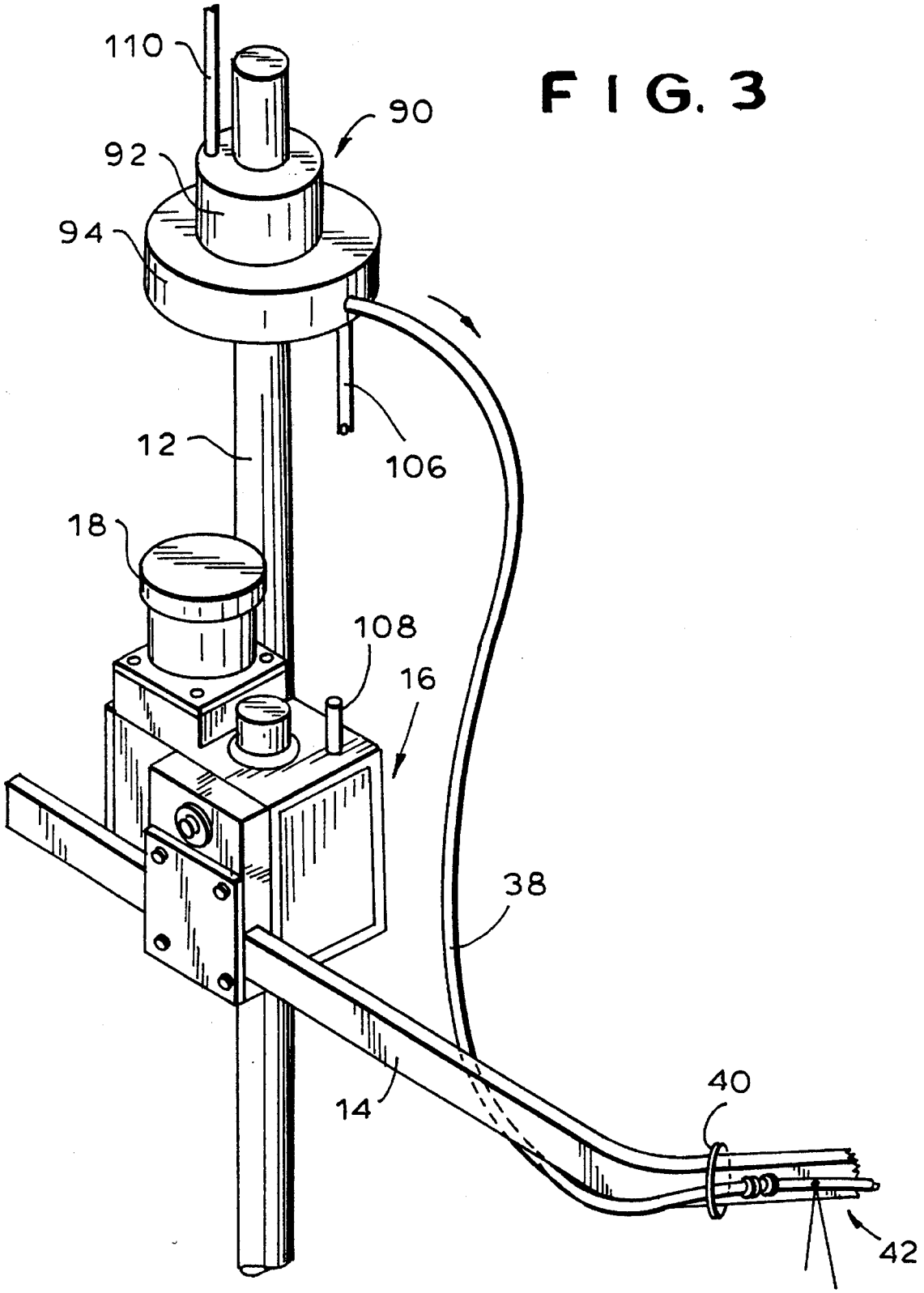
FIG. 3 is a perspective view of the central part of an alternative embodiment, wherein the fan cleaning apparatus is in the nature of a retrofit.
Figure 4:
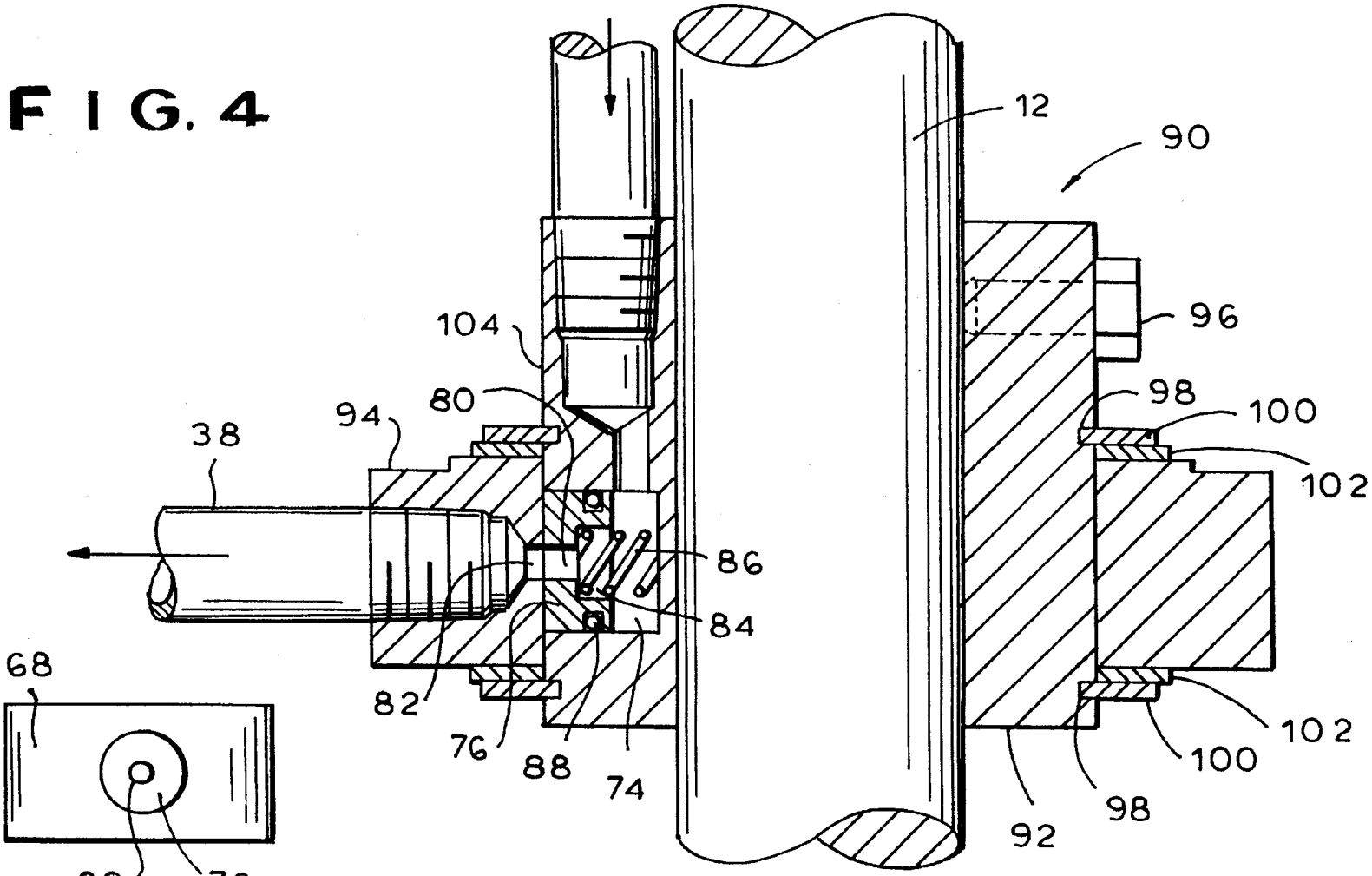
FIG. 4 is a detailed view in cross-section of the retrofit form of the invention.

As presented in FIGS. 1, 2 and 5, the present invention may be embodied in a central journal system providing both electrical commutation as well as cycling of the cleaning air flow. It is also comprehended, however, that the present invention may be in the form of a retrofit. As depicted in FIGS. 3 and 4, such a retrofit may be, for example, exemplified by a system in which the source of compressed air is located above the knitting machine and fan.

As depicted in those Figures, a retrofit pneumatic coupler 90 may once again include a central portion 92 about which ring 94, to which pipe 38 is coupled, is journaled. The central portion 92 is rigidly affixed to the vertical shaft 12 by setscrews 96 or other appropriate means.

With particular reference to FIG. 4, the cylindrical lateral face 104 of central portion 92 may be provided with spaced circumferential grooves 98, into which a pair of retaining rings 100 are mounted. A pair of rings or washers 102 are placed between the support rings and the main ring 94, provide a low-friction intermediate contact surface between the support rings and the main ring, and serve to maintain the main ring in appropriate position upon the lateral face 104. The main ring may preferably be formed of a low-friction, low coefficient of expansion plastic. The internal construction of the coupler is otherwise as depicted in FIG. 2, incorporating the block 76 mounted in the window 74 provided through the central portion lateral face. Compression spring 86 presses the block into sealing contact with the inner surface of the ring 94, while the O-ring 88 seals the block to the window sidewall.

The ring 94 may be provided with an extending pin or dog 106 which mate with a complimentary ring-like coupling 108 which is mounted upon the rotating portion of journal assembly 16. The retrofit unit is positioned on the shaft 12 such that the pin 106 is engaged by the coupling unit 108, at which time the central portion of the retrofit is locked in place. Rotation of the journal assembly is coupled to the ring 94 through the pin, the ring thus being driven in synchronism with rotation of the journal and arm. Alternatively, the pin or dog may merely contact a side of the journal assembly, rotation of the journal assembly exerting a sideways force on the dog and directing the ring around the shaft 12. The air inlet hose 110, coupled to an overhead source of compressed air, completes the system.

It will be apparent to one skilled in the art that the foregoing detailed description is merely illustrative of the present invention, and that modifications and alterations to the disclosed embodiments may be accomplished without departing from the true scope of the invention.

We claim:

1. Compressed gas cleaning apparatus for use in conjunction with a blower mounted to an arm rotatably mounted to a fixed central member, comprising a gas input line;

a pneumatic coupler coupled to said input line located at the intersection of said arm and central member having a first portion mounted to said central member, a rotatable second portion and a gas outlet in said second portion;

a pipe coupled to said gas outlet and mounted to said arm; and nozzle means coupled to said pipe for directing compressed gas at said blower.

2. The apparatus of claim 1, wherein said nozzle means comprises a plurality of nozzles located and arranged to deliver a curtain spray of gas.

3. The apparatus of claim 2, wherein said plurality of nozzles are disposed in a common plane.

4. The apparatus of claim 3, wherein a first set of said nozzles is aligned along a first straight path in said plane and a second set of said nozzles is aligned along a second straight path in said plane.

5. The apparatus of claim 1 further comprising valve means coupled to said pipe for controlling the flow of gas to said nozzles.

6. The apparatus of claim 5, wherein said valve means includes control means responsive to the rotation of said arm.

7. A compressed gas cleaner apparatus for use in conjunction with a blower mounted to an arm rotatably journaled to a fixed central member comprising: a journal assembly having a first portion mounted to said central member and a second portion mounted for rotation with respect to said first portion; a gas inlet in said first portion and a gas outlet in said second portion; means in said first and second portions for coupling said air inlet and said air outlet during a portion of a period of rotation of said second portion about said first portion; drive means coupled to said second portion for rotation thereof in synchronism with said arm; and nozzle means coupled to said air outlet for directing a flow of compressed gas towards said blower.

8. The apparatus of claim 7, wherein said journal assembly first portion includes a cylindrical lateral face having a window therein coupled to said air inlet, said second portion being in the form of a ring rotatable upon and about said lateral face, said ring having a transverse bore therethrough coupled to said air outlet; said transverse bore and said window being in alignment during a portion of said second portion rotation to couple said air inlet to said air outlet.

9. The apparatus of claim 8 further comprising a gasket mounted in said window to seal said window against said ring.

10. The apparatus of claim 9, wherein said gasket is biased against said ring.

11. The apparatus of claim 10, wherein said gasket is in the form of a block having an outer face conforming to the curvature of said cylindrical outer wall and having a transverse bore extending through said outer face to align with said transverse bore in said ring.

12. The apparatus of claim 11 further comprising a pair of spaced rings extending outwardly from said cylindrical outer wall, said ring being positioned therebetween.

13. The apparatus of claim 12, wherein said drive means comprises a dog extending from said ring for driving contact with said arm.

14. The apparatus of claim 11, wherein said journal assembly further comprises an electrical commutator between said first portion and a commutator outer portion journaled for rotation thereabout and connected to said arm; an arm rotation drive motor mounted to said commutator outer portion; said drive means joining said ring to said commutator outer portion.

15. The apparatus of claim 14, wherein said drive means comprises a bolt passing through said ring, said commutator outer portion having a threaded bore to accept said bolt.

* * * * *